US006539650B2

(12) United States Patent
Kaczmarski et al.

(10) Patent No.: US 6,539,650 B2
(45) Date of Patent: Apr. 1, 2003

(54) SWIVEL MOUNTING FOR QUICK ATTACHMENT BRACKET

(75) Inventors: Wally L. Kaczmarski, Lisbon, ND (US); Craig A. Berard, Oakes, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 09/730,516

(22) Filed: Dec. 5, 2000

(65) Prior Publication Data

US 2002/0066215 A1 Jun. 6, 2002

(51) Int. Cl.[7] ..... E02F 3/76
(52) U.S. Cl. ..... 37/468; 414/723
(58) Field of Search ..... 172/272, 275; 37/468, 403, 903; 414/723

(56) References Cited

U.S. PATENT DOCUMENTS

| | | | | |
|---|---|---|---|---|
| 3,343,693 A | * | 9/1967 | Becker | 414/693 |
| 4,232,849 A | * | 11/1980 | Kimber et al. | 248/654 |
| 4,397,604 A | | 8/1983 | McCain | 414/723 |
| 4,422,366 A | | 12/1983 | Weyer | 91/26 |
| 4,571,146 A | | 2/1986 | Eriksson | 414/687 |
| 4,639,183 A | | 1/1987 | Guthoff | 414/705 |
| 4,779,364 A | | 10/1988 | Holmdal | 37/117.5 |
| 4,906,161 A | | 3/1990 | Weyer | 414/705 |
| 4,948,328 A | | 8/1990 | Busch | 414/723 |
| 4,955,779 A | | 9/1990 | Knackstedt | 414/723 |
| 5,145,313 A | | 9/1992 | Weyer | 414/723 |
| 5,242,258 A | | 9/1993 | Weyer | 414/723 |
| 5,487,230 A | | 1/1996 | Weyer | 37/468 |
| 5,515,626 A | | 5/1996 | Holscher | 37/468 |
| 5,561,926 A | * | 10/1996 | Stratti | 37/468 |
| 5,727,342 A | | 3/1998 | Horton | 37/468 |
| 5,850,704 A | | 12/1998 | Harinen | 37/468 |
| 5,865,492 A | | 2/1999 | Horton | 294/86.41 |
| 5,974,706 A | | 11/1999 | Kaczmarski et al. | 37/468 |
| 5,983,535 A | | 11/1999 | Kaczmarski et al. | 37/468 |
| 6,000,154 A | | 12/1999 | Berard et al. | 37/468 |
| 6,146,082 A | * | 11/2000 | York | 414/723 |
| 6,163,989 A | | 12/2000 | Kaczmarski et al. | 37/468 |

FOREIGN PATENT DOCUMENTS

| | | |
|---|---|---|
| DE | 42 08 245 A1 | 9/1993 |
| DE | 296 13 739 U1 | 10/1996 |
| DE | 198 06 057 A1 | 9/1999 |
| GB | 2 305 909 A | 4/1997 |

OTHER PUBLICATIONS

"Equipment Ideas", p. 175 from Construction Equipment, publication date is unknown but admitted prior art.
"Mini Excavator Universal Attachment System", Weldco–Beales Mfg. Inc. brochure, two pages, publication date is 1999 (admitted prior art).
"Does your Quick Coupler System Measure Up?", Weldco–Beales Mfg. Ltd. brochure, publication date Mar. 1998 (admitted prior art).
"Excavator Quick Couplers", Weldco–Beales Mfg. Inc. brochure, two pages, publication date 1999.
"Universal Attachment System", Kenco brochure, one page, publication date unknown (admitted prior art).
Powertilt Swing Attachment brochure, 8 pages, publication date Jan. 1995.

* cited by examiner

*Primary Examiner*—Thomas B. Will
*Assistant Examiner*—Meredith Petravick
(74) *Attorney, Agent, or Firm*—Westman, Champlin & Kelly, P.A.

(57) ABSTRACT

A swivel connection for quick attachment bracket equipped excavator booms. The swivel connection has a frame that mounts onto a quick attachment bracket on an excavator or backhoe boom, and the frame pivotally mounts a second attachment bracket about a swivel axis. The second attachment bracket is adapted to fit into a frame on an implement that also is connectable to the bracket on the boom. An implement attached to the second bracket this can be pivoted relative to the frame of the swivel connection. A linear hydraulic actuator is used for controlling the pivoting movement of the second bracket relative to the frame.

9 Claims, 5 Drawing Sheets

SWIVEL MOUNTING FOR QUICK ATTACHMENT BRACKET

CROSS REFERENCE TO RELATED PATENTS

Reference is made to U.S. Pat. No. 5,974,706 and to U.S. Pat. No. 5,983,535 both of which are incorporated herein by reference in their entirety.

BACKGROUND OF THE INVENTION

The present invention relates to a swivel connection for use between a quick attachment mounting frame and a quick attachment bracket to permit a bucket or other attachment coupled to a boom to be pivoted about a generally horizontal axis during use for cutting a grade slope or working at an angle, and still have the benefit of a quick attachment bracket for engaging a frame on the bucket.

Quick attachment units have been utilized for excavator buckets and other attachments. For example U.S. Pat. No. 5,974,706 illustrates such a quick attachment system, where a bracket can be used for mounting frames that are attached to various tools so the tools can quickly be mounted to an excavator or backhoe boom. Also, U.S. Pat. No. 5,983,535 shows a quick attachment bracket and frame which are held in assembly with a bolt on connection.

Excavator or backhoe booms pivot about generally horizontal axes, and these horizontal pivots are fixed. However, it is desired from time to time to cut a slope with the bucket, or use an attachment such as a powered earth auger at an angle other than vertical. The present devices do not provide a low cost positive holding angular displacement swivel for use with a quick attachment bracket on a bucket or a tool.

SUMMARY OF THE INVENTION

The present invention relates to a hydraulically controlled swivel connected between a backhoe or excavator boom and an attachment tool implement. The swivel has a frame on one end that attaches to a quick coupler bracket on the boom. A second bracket that will couple to a similar frame is pivotally mounted to the frame of the swivel. The second bracket is for connection to a frame on a bucket or other attachment or implement. The swivel frame and bracket are held together with a pivot pin which, is substantially horizontal when the excavator bucket is moved to a position with the bucket cutting blade or edge lowered. A linear hydraulic cylinder is mounted between the swivel frame and the second bracket for pivoting the second bracket about the axis of the pivot pin so that the bucket cutting blade or other implement or tool can be positioned at an angle or slope during use.

The linear hydraulic cylinder used can be mounted on end pivot pins, as shown, or on trunnions at a desired location along the cylinder. While one linear cylinder is shown, two linear cylinders, one on each side of the pivot pin could be used.

DETAILED DESCRIPTION OF THE PREFERRED EMBODIMENTS

Figure 1:
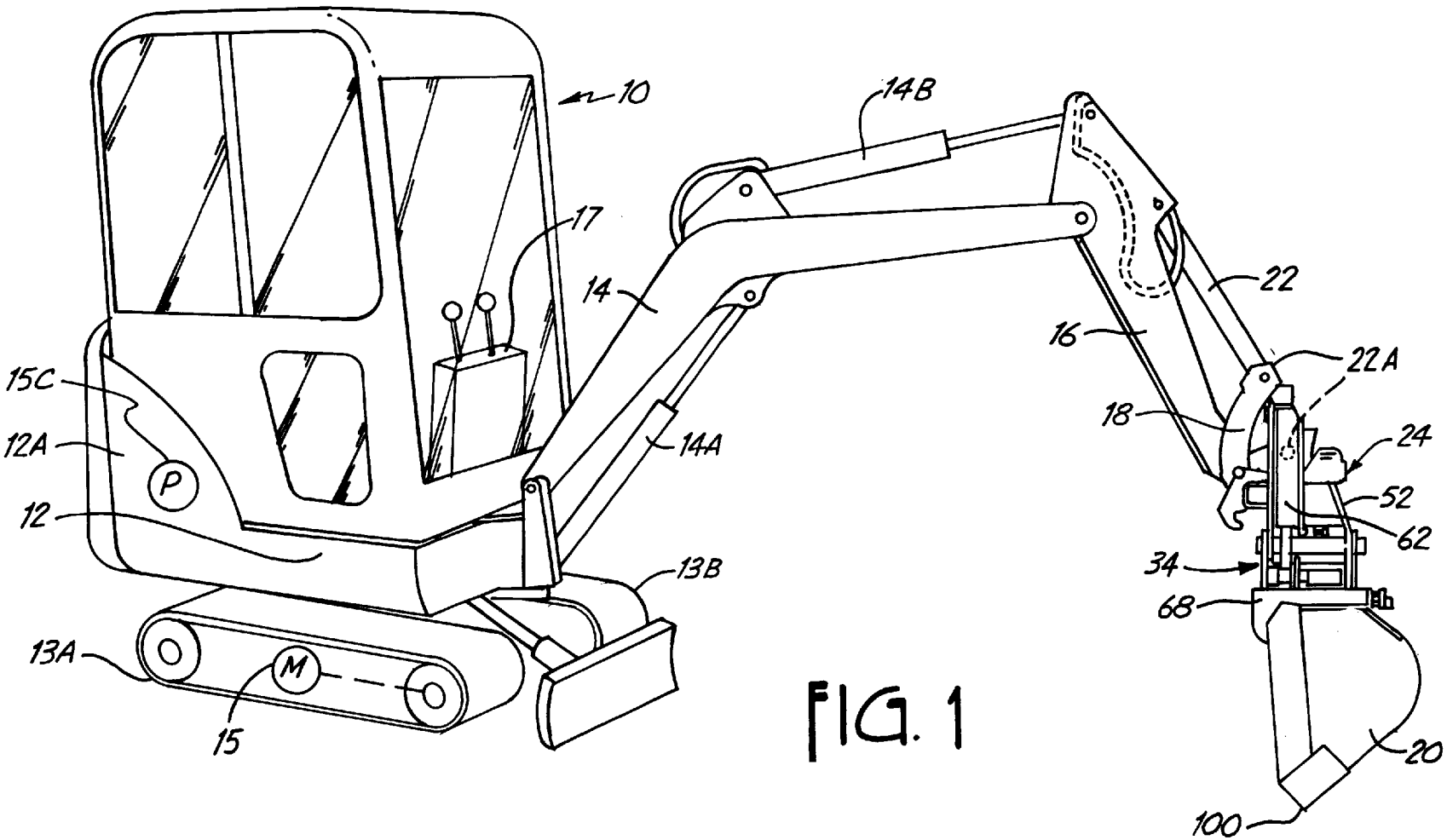
FIG. 1 is a perspective view of an excavator having a bucket mounted on a swivel made according to the present invention.

FIG. 1 illustrates an excavator 10 of typical configuration, to show an implement or machine on which the present control arrangement is mounted. The excavator 10 includes a frame 12, mounting an engine in a compartment 12A. The excavator drive tracks 13A and 13B are mounted on suitable sprockets and axles, and are driven by hydraulic motors 15, shown schematically. The motors 15 could also be electric, and controlled by a switch assembly. The tracks 13A and 13B on opposite sides of the excavator are used for driving the excavator along the ground and for steering. The excavator can be turned right and left, by selectively driving the tracks, which can be driven in forward and rearward directions.

The engine in the engine compartment 12A is used for driving various components, including a hydraulic pump 15C that will provide hydraulic pressure for the drive motors 15 for tracks 13A and 13B, and also for operating actuators such as the actuator or cylinder 14A for a main or base boom arm 14, and an actuator or cylinder 14B for controlling a dipper arm 16 that is pivoted to the end of base arm 14. The actuator boom, dipper arm and a bucket 20 are operated in a normal manner. These actuators may be controlled by a conventional joystick control 17 comprising a handle movable to control the various functions of the boom, dipper arm and bucket.

Figure 2:
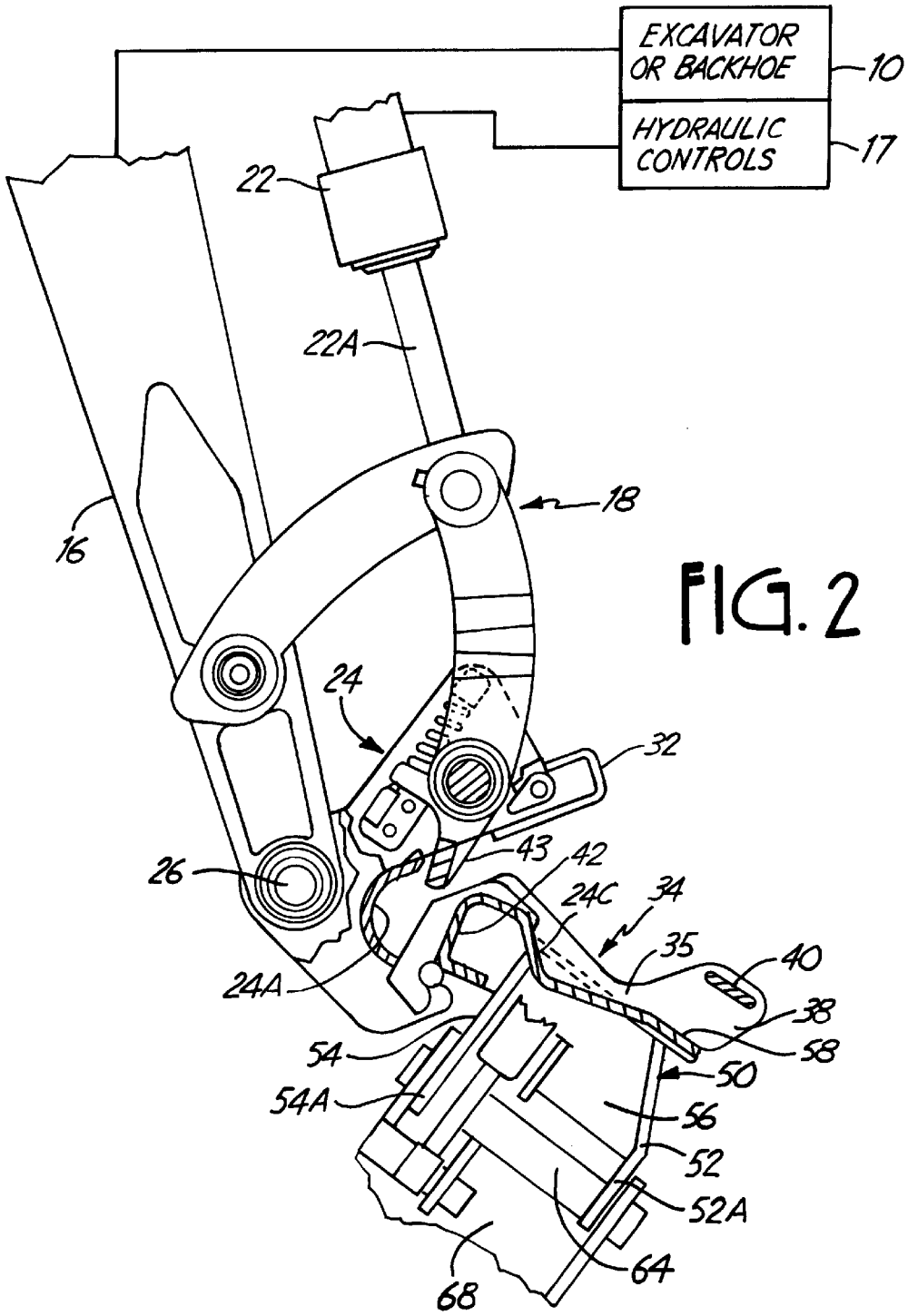
FIG. 2 is an enlarged fragmentary view of the end of the excavator boom and the swivel in place.

The base arm 14 is pivoted to a bracket on the frame 12 about a horizontal pivot. The pivot of the dipper arm 16 to the base arm is parallel to the base arm pivot. The outer end of the dipper arm 16 includes a folding link assembly 18 that is used for controlling pivoting of a tool such as the bucket 20. The link is actuated by double acting hydraulic actuator shown schematically at 22 and operated through controls 17. The actuator 22 extends and retracts an actuator rod 22A (FIG. 2) under power and controls the tool pivoting about a horizontal axis. The link assembly 18 connects to a quick attachment bracket 24 that is pivotally mounted on a pin 26 to the outer end of the arm 16, again about a pivot parallel to the base arm or boom pivot. The actuator 22 acting through the linkage 18 controls the pivoting of the quick attachment bracket 24 about the axis of the pin 26.

The bracket 24 is a quick attachment bracket that can have an automatic latch such as shown in U.S. Pat. No. 5,974,706, that will support a swivel assembly 34. The bracket 24 is not shown in detail. The swivel assembly includes a frame 35 comprising a pair of side plates 36 and 38, that will straddle the bracket 24, and will permit a nose end 32 of the bracket 24 to fit underneath a crossbar 40. In addition, the frame 35 has a cross member 42 that fits into a mating saddle 24A on the bracket 24. A releasably spring-loaded latch dog 43 on the bracket engage a latch surface 24C on the frame 35 to hold the frame 35 on the bracket 24 until the latch dog 43 is released.

The frame 35 is not directly attached to an implement, as it is in U.S. Pat. Nos. 5,974,706 and 5,983,535, but forms part of the swivel 34. The frame 35 carries a swivel support bracket 50 that has spaced end bracket plates 52 and 54, respectively, that are held together with one or more panels 56. The panel 56 and bracket plates 52 and 54 are all welded into place on a quick attachment frame base plate 58 that also supports the frame side plates 36 and 38 on an opposite side of the base plate from the bracket 50.

The panels 56 are perpendicular to the base plate 58 and support the spaced end bracket plates 52 and 54. Laterally and outwardly extending arms 60A and 60B that are parallel to each other are fixed to the bracket 50. The arms 60A and 60B extend back toward and beyond the quick attachment frame side plates 36 and 38, and extend alongside dipper arm 16. When the swivel frame 50 is in a position shown in FIGS. 3 and 4 the arms 60A and 60B, extend upwardly. The arm 60A and 60B are spaced so they support a hydraulic cylinder 62 between them. The cylinder end is pinned to the outer ends of the arms.

A pivot hub 64 is mounted between the outer end portions 52A and 54A of the end bracket plates 52 and 54. The arm 60B is an integral part of the plate 54, as shown, but can be welded in place if desired. The arm 60A is welded to the panel 56 and extends laterally therefrom.

A second attachment bracket 68 (FIGS. 3 and 4) is mounted to the swivel support bracket 50 for pivotal movement about the axis of hub 64. The second quick attachment bracket 68 has a pair of plates 72 and 74 extending therefrom that overlap the ends 52A and 54A of the frame plates 52 and 54. A pin 70 passes through the sleeve 64 and the ends of the plates 72 and 74 so the bracket 68 is mounted on swivel bracket 50, and thus on frame 35 and forms a part of swivel 34. Additionally, the bracket 68 has an ear 76 mounted thereon, with a bore which aligns with a bore on plate 74 that carries a pin 77 that holds a rod end 78 on the rod of the double acting, linear hydraulic actuator 62. The actuator 62 will control the angle of the second bracket 68 about the axis 71 of the pin 70.

Figure 3:
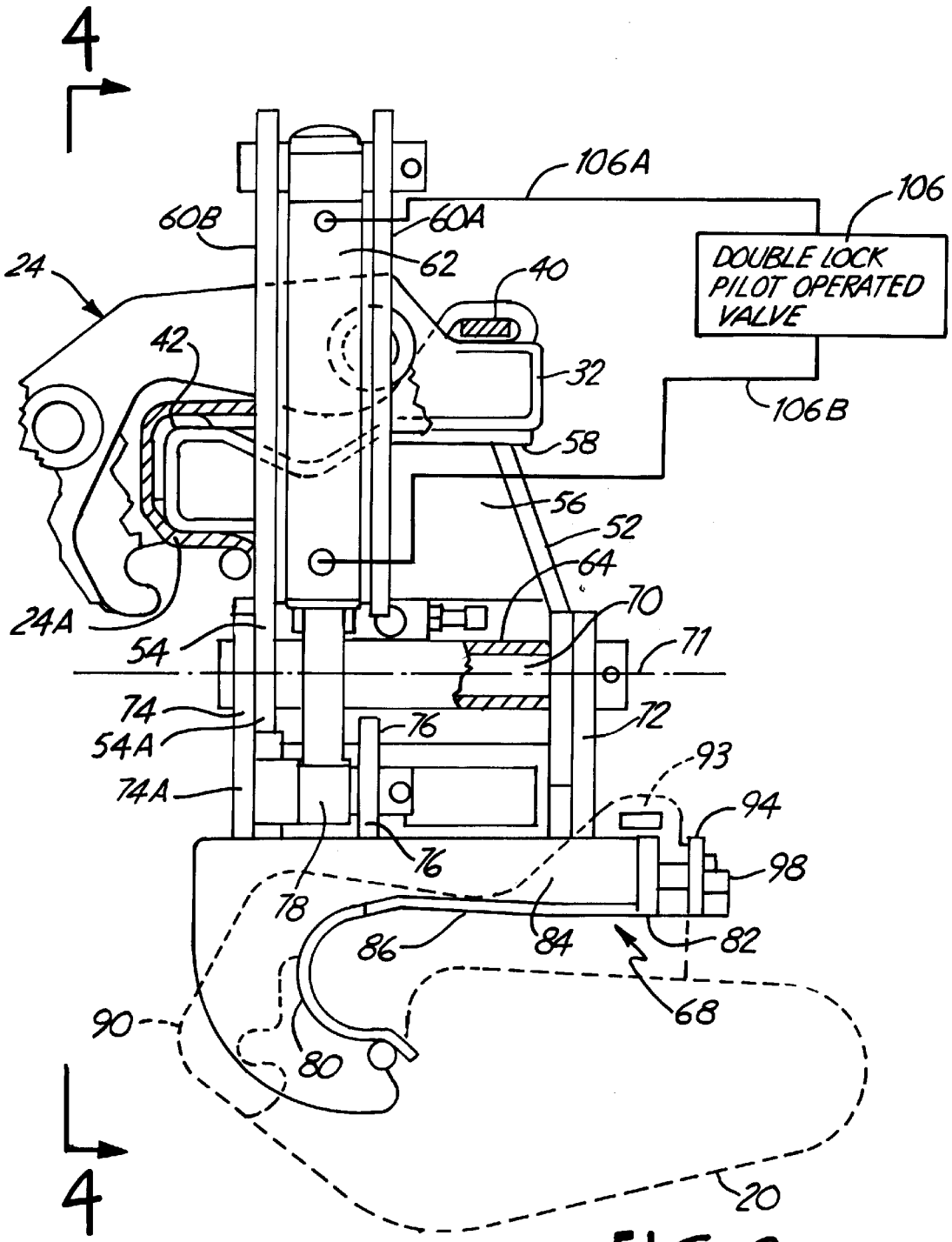
FIG. 3 is a side view of the swivel.

In FIG. 3, the swiveling second bracket 68 is shown without a bucket or blade attached for sake of clarity. It can be seen that the swiveling second bracket 68 has a saddle 80 that is open in direction facing toward a nose portion 82 that is formed by a pair of side plates 84. The side plates 84 are held together with a cross plate 86 from which the saddle 80 is made. The details of the saddle, side plates and cross plate of bracket 68 are shown in the prior mentioned U.S. Pat. No. 5,983,535. The bracket 24 on the end of the arm 16 has a saddle constructed in the same manner, but includes the automatic latch arrangement shown in U.S. Pat. No. 5,974,706.

Figure 6:
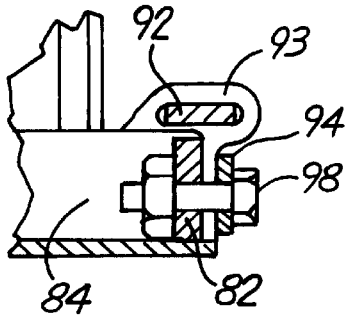
FIG. 6 is a detail of the retainer between the swivel bracket and a frame on a bucket or blade.

The swiveling second bracket 68 receives and supports a quick attachment frame 90 of the excavator bucket or other implement 20. Frame 90 includes a pair of side plates 93, and an end cross member 94 that fits into the saddle 80. The side plates 93 are spaced sufficiently so they fit on the outer sides of the side plates 84 and cross plate 86 of the swiveling second bracket 68. The nose member 82 fits beneath a retainer bar 92 on the frame 90 on the bucket 20 as shown in FIG. 6. A cross bar 94 is positioned to extend between and rest on outer ends of both of the side plates 93 on the frame 90. The bar 94 is held against the edges of the side members 93 of the frame 90 and the nose member 82 of the bracket 68 is pulled into place and held with cap screws 98, also as shown in FIG. 3 of U.S. Pat. No. 5,983,535. When the bucket 20 or other tool or implement and frame 90 are positioned substantially as shown in FIGS. 1 and 3, and the swivel assembly is mounted on the boom dipper arm 16, it can be seen that by extending and retracting the rod of linear actuator or cylinder 62, the angle of the blade 100 of the bucket 20 relative to a horizontal plane can be changed, since the bracket 68 swivels about the axis 71 of pin 70. The second frame can be attached to a bulldozer blade or larger bucket if desired, or can support a tool such as an earth auger or hydraulic breaker.

The cylinder 62 is controlled by a double lock pilot operated valve 106 of conventional design to prevent leakdown of the cylinder 62 when it is under load. Hydraulic pressure from the valve 106 to either of the outlets from the valve connected to lines 106A or 106B serves as pilot pressure to open check valves to permit flow into and out of cylinder 62. The check valves normally prevent flow out of either end of the cylinder to insure that the cylinder 62 remains in a fixed position. Thus, there is no unwanted change in angular position because of valve leakage.

The use of a direct acting linear hydraulic cylinder or actuator 62 provides for a very rugged and controllable positioning of the angle of the bucket blade or other tool under boom loading. A set angle of slope on a ditch or the like can be obtained. The dipper arm of the excavator used for moving the bucket toward or away from the excavator body to form an angle cut. The slope angle of a ditch or channel can be maintained as the angled blade 100 moves along the ditch. Augers and hammers can be held at an angle during use as well.

Figure 4:
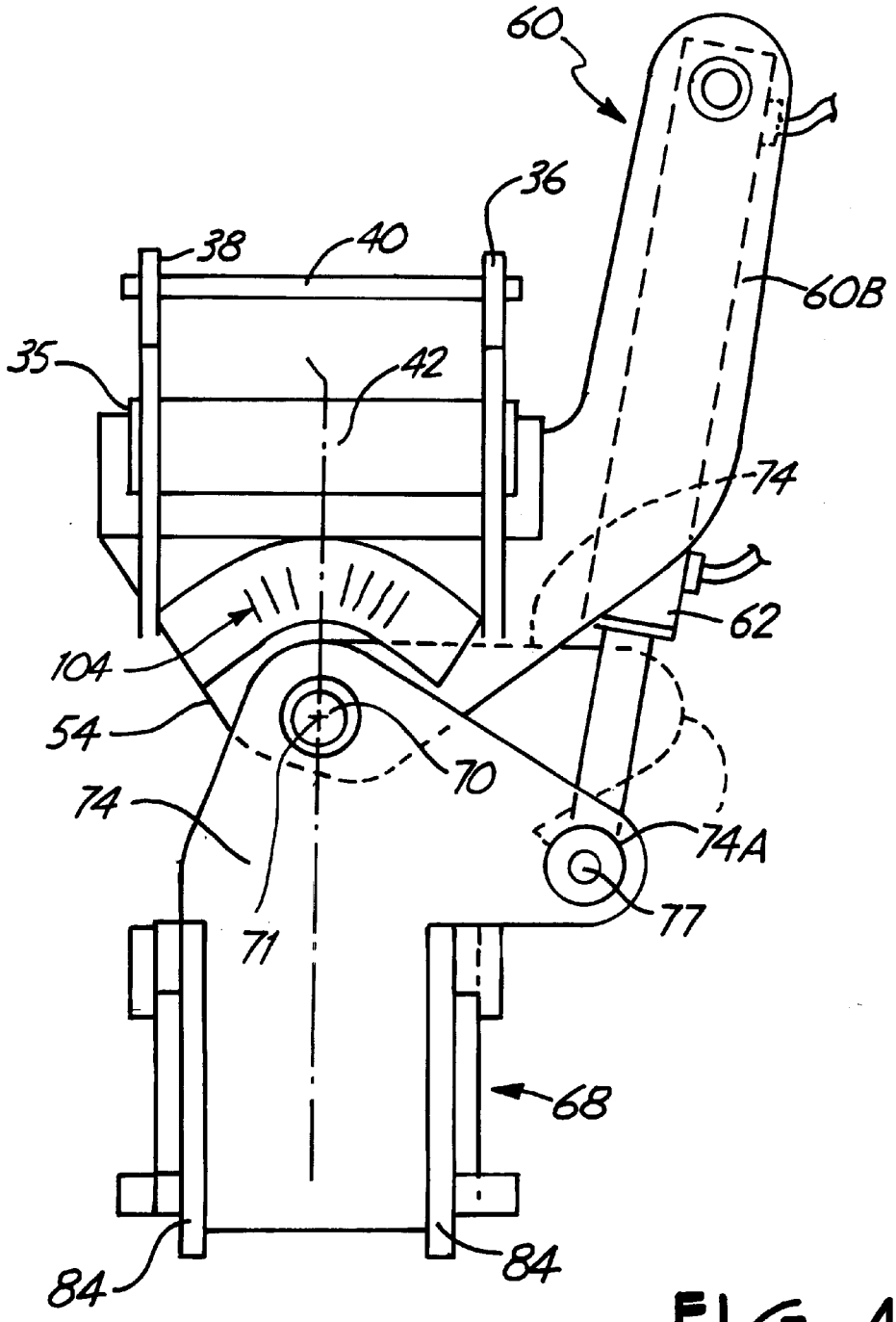
FIG. 4 is an end view of the swivel taken generally along line 4—4 in FIG. 3, with a boom mounted bracket removed.
Figure 5:
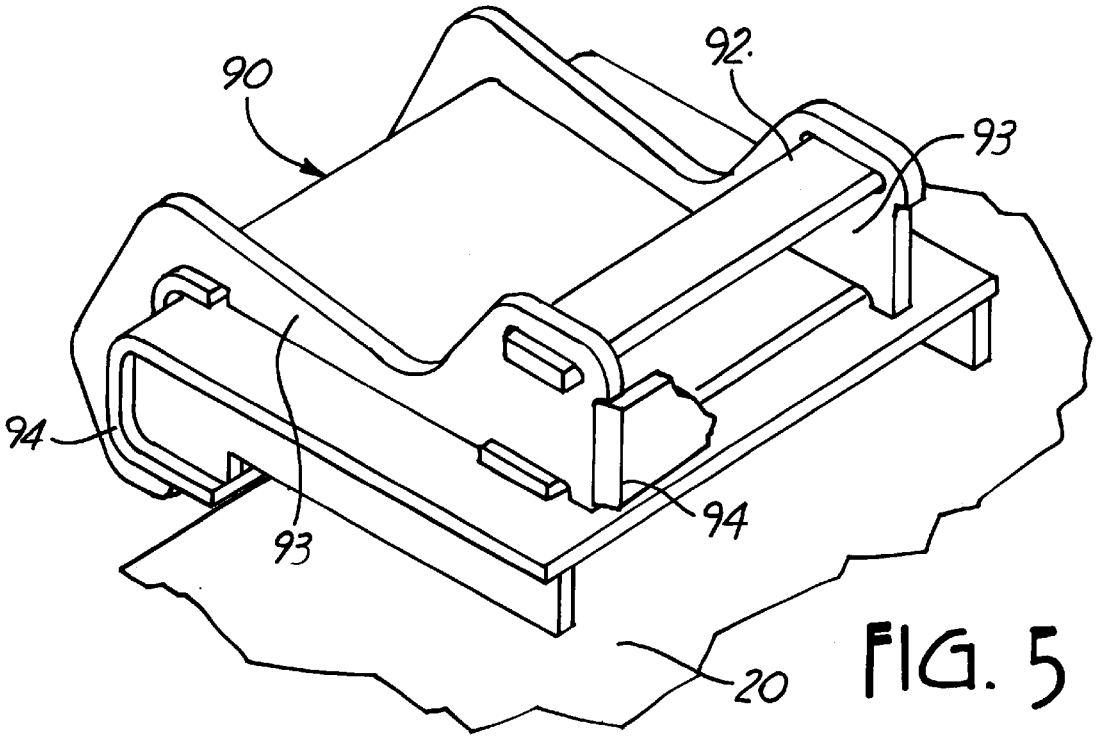
FIG. 5 is a fragmentary schematic view of a quick attachment frame mounted on an excavator bucket.

A total swiveling or pivoting movement about pin 70 of approximately 30° in each direction can be obtained using the hydraulic cylinder 62. In FIG. 4, angle indicator marks 104 are shown schematically. Also, a dotted position of the plate 74 is shown in FIG. 4. It should be noted that the pin axis 71 extends in fore and aft direction of the excavator, perpendicular to the axis of pivoting of the excavator backhoe boom, so that the angle can be maintained to provide a slope relative to the pivot axis of the boom, and thus relative to a horizontal plane.

As stated, while one linear cylinder is shown, two cylinders, one on each side of the pivot pin, can be used. The cylinders also can be mounted as desired. The linear cylinder swivel can be used with any type of quick attachment bracket arrangement.

Although the present invention has been described with reference to preferred embodiments, workers skilled in the art will recognize that changes may be made in form and detail without departing from the spirit and scope of the invention.

What is claimed is:

1. A quick attachment assembly for use on a boom that is mounted about a generally horizontal axis pivot relative to a support platform, the quick attachment assembly including a first attachment bracket mounted on said boom, about a horizontal pivot, a saddle and an attachment portion spaced from the saddle, a frame having a pair of spaced plates and a cross member at one end joining the plates and adapted to fit in the saddle, and a receiver on the frame plates for receiving the attachment portion for coupling to said first bracket, said frame having a second attachment bracket pivotally mounted thereon about a swivel pivot axis perpendicular to the pivot axis of the boom that replicates the first bracket for receiving an attachment, an arm mounted on the frame and extending to one lateral side of the frame toward the first bracket to a mounting end, and a linear hydraulic actuator mounted between the mounting end of the arm and the second bracket for controlling the positioning of the second bracket relative to the first frame.

2. The assembly of claim 1, wherein said linear actuator is extendable and retractable for pivoting the second bracket about the swivel pivot axis.

3. The assembly of claim 2, wherein said first bracket is pivotally mounted to said boom about a pivot axis parallel to the pivot between the boom and the support platform.

4. A quick attachment swivel assembly for mounting on the end of a boom carrying a quick attachment bracket having frame receiving members for latching a frame in place, said assembly including a first frame having portions for coupling to the frame receiving members of a bracket and having a portion for retaining the first frame on such mating bracket, a second bracket pivotally mounted to said first frame, said second bracket being configured to have identical frame receiving members for latching a frame in place identical to a quick attachment bracket carried on a boom, to receive a second mating frame mounted on an implement, which has portions for coupling identical to the first frame, said pivotal mounting of the second bracket to the first frame being between the first frame and the second, bracket, and a linear actuator mounted between the first frame and the second bracket for controlling pivoting of the second bracket about the pivotal mounting of the second bracket.

5. The swivel assembly of claim 4, wherein said linear actuator has a line of action that is offset from the pivotal mounting, and the first frame being oriented so the pivotal mounting has a swivel axis substantially horizontal at least during portions of the operation of the swivel assembly.

6. The swivel assembly of claim 4, wherein said pivotal mounting comprises a pair of spaced apart plates on the second mating frame, a pivot tube mounted on said spaced apart plates, and a pair of ears on the second bracket that are on opposite sides of the spaced plates and straddle the plates, and a pin passing through said pivot housing and said ears on said second bracket, whereby the pin pivotally mounts the second bracket to the first frame.

7. The swivel connection of claim 4, wherein said first frame compromises a pair of spaced apart frame plates, and the portions for coupling comprise a cross member joining said frame plates and adapted to fit into a saddle on a bracket on the boom, and a second end for receiving and retaining an attachment a portion of a bracket on the boom.

8. The swivel connection of claim 7, wherein said second bracket has support plates, a saddle receptacle at one end of said second bracket, and a second attachment portion on an opposite end of said bracket adapted to be retained on the plates on a second frame on an implement to retain the second frame in position in the saddle receptacle.

9. The swivel connection of claim 4, wherein a double lock pilot operated valve is used for controlling the linear actuator.

* * * * *